United States Patent [19]

Henderson et al.

[11] Patent Number: 4,856,123

[45] Date of Patent: Aug. 15, 1989

[54] TOILET APPARATUS FOR USE BY BED RIDDEN PATIENTS

[75] Inventors: D. Grant Henderson; Grenville K. Yuill; David Kroeker, all of Winnipeg, Canada

[73] Assignee: Henderson Medical Appliance Company Ltd., Winnipeg, Canada

[21] Appl. No.: 100,660

[22] Filed: Sep. 24, 1987

[51] Int. Cl.[4] ..... A61G 7/02

[52] U.S. Cl. ..... 4/480; 4/564; 5/63; 5/81 R; 5/90; 297/320

[58] Field of Search ..... 4/496, 480, 560–566; 5/63, 81 B, 86, 81 R, 90; 297/320, 345

[56] References Cited

U.S. PATENT DOCUMENTS

| | | | |
|---|---|---|---|
| 2,673,987 | 4/1954 | Upshaw et al. | 5/86 |
| 2,869,614 | 1/1959 | Wamsley | 4/480 X |
| 2,915,112 | 12/1959 | Schwartz | 5/81 R X |
| 3,050,741 | 8/1962 | Coleman | 4/480 |
| 3,147,039 | 9/1964 | Smith et al. | 5/86 X |
| 3,166,282 | 1/1965 | Nolan | 4/564 X |
| 3,261,031 | 7/1966 | Gates . | |
| 3,495,869 | 2/1970 | Ingemansson | 5/81 R X |
| 3,541,617 | 11/1970 | Clanan . | |
| 3,666,131 | 5/1972 | Thompson . | |
| 3,786,523 | 1/1974 | Sele . | |
| 3,790,974 | 2/1974 | Johansson . | |
| 3,869,171 | 3/1975 | Wilson . | |
| 3,882,555 | 5/1975 | Edlund . | |
| 3,936,893 | 2/1976 | Anderson et al. | 5/81 R |
| 3,940,808 | 3/1976 | Petrini . | |
| 3,962,736 | 6/1976 | Fedele . | |
| 3,967,328 | 7/1976 | Cox . | |
| 3,981,484 | 9/1976 | James . | |
| 3,997,926 | 12/1976 | England . | |
| 4,023,218 | 5/1977 | Di Matteo . | |
| 4,119,342 | 10/1978 | Jones | 5/81 R X |
| 4,193,147 | 3/1980 | Fischer | 5/81 R |
| 4,211,216 | 7/1980 | Burgess et al. . | |
| 4,232,412 | 11/1980 | Petrini . | |
| 4,255,823 | 3/1981 | Boyer et al. . | |
| 4,632,450 | 12/1986 | Holdt | 5/81 R X |
| 4,639,954 | 2/1987 | Speed | 5/63 X |

*Primary Examiner*—Charles E. Phillips

*Attorney, Agent, or Firm*—Adrian D. Battison; Stanley G. Ade; Murray E. Thrift

[57] ABSTRACT

A toilet apparatus for use with bed ridden patients comprises a frame which provides an upper horizontal patient support so that the patient can be transferred from a lying condition in a bed onto the support. A back portion of the support then pivots about a point on a line with the waist of the occupant to define a back portion move to a vertical position and a seat portion rolls along a cam track to a lowered position together with a leg rest portion which pivots downwardly. The occupant therefore takes up the seated condition and can make use of toilet facilities attached to the seat portion. The pivot point retains the center of gravity of the patient at the level of the frame so that little lifting or lowering force is required.

3 Claims, 4 Drawing Sheets

TOILET APPARATUS FOR USE BY BED RIDDEN PATIENTS

BACKGROUND OF THE INVENTION

This invention relates to a toileting apparatus for use by bed ridden patients.

Conventionally patients who are confined to bed either by virtue of a general weakness or a specific injury are obliged when wishing to avail themselves of toilet facilities to be lifted onto or to position themselves onto a bedpan. In many cases the bedpan comprises simply a stainless steel bowl with a suitable shaped upper rim upon which the patient can sit. Some patients are insufficiently strong or have infirmities which prevent them from sitting and this can be extremely uncomfortable, discouraging and demeaning and acts as a severe deterrent to normal bodily functions. However, to date, no arrangement has been proposed or manufactured which in any way alleviates the problems which arise in this circumstance leaving the patients to suffer and the staff to struggle with any difficulties that may arise.

It is one object of the present invention, therefore, to provide a toileting apparatus for use by such bed ridden patients which overcomes many of the difficulties outlined above.

SUMMARY OF THE INVENTION

According to the invention, therefore, there is provided a toileting apparatus for use by bed ridden patients comprising a patient support including a seat portion, and a back rest portion frame means mounting said portions such that they can be moved from a first position in which they lie in a substantially flat co-planar relationship for supporting the patient in a lying condition to a second position in which the back rest portion is inclined upwardly from the seat portion for supporting the patient in an at least partially seated condition, said frame means being adapted and arranged such that in the first position the patient in the bed can be positioned onto and removed from the patient support, the seat portion being apertured for use as a toilet seat, and means for supporting a toilet bucket positioned beneath the seat portion for use in the second position of the patient support.

Preferably the apparatus is arranged such that the frame supports the patient support in its first position such that it can be moved alongside a bed and retained at the bed height for movement of the patient from the bed onto the support. Such a movement is of course many times carried out by staff since patients must in many cases be moved onto a gurney.

Preferably the apparatus is then arranged so that the seat portion moves downwardly while the back portion pivots upwardly and a leg portion pivots downwardly away from the seat portion so that the center of gravity of the patient remains substantially constant to avoid any large scale lifting or lowering of the patient's weight on the apparatus.

Thus the patient can be moved from the lying position into seated position or a partial seated position by simple mechanical pivoting of the portions so that the patient can carry out the toilet function in a more comfortable orientation. When completed, the patient can simply be pivoted back to the lying position with the portions in their planar form and the patient slid back into the bed in conventional manner. Thus the patients weight together with a small lifting force by an attendant can move the patient into and out of the seated position without motors, cranks or the like.

According to a particularly preferred arrangement, the seat portion is pivoted to the back portion at a rear edge thereof with the back portion pivotal about an axis spaced along the back portion from the seat portion by a distance to accommodate the approximate center of gravity of the patient. The seat portion can then move downwardly along a cam track or lever arrangement arranged at the forward end of the seat portion so that the seat portion is wholly supported by the cam track and by its pivotal coupling with the back portion. This provides a simple mechanical linkage which allows the required movement and reduces to a minimum any possible pinch points between the portions and the frame.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
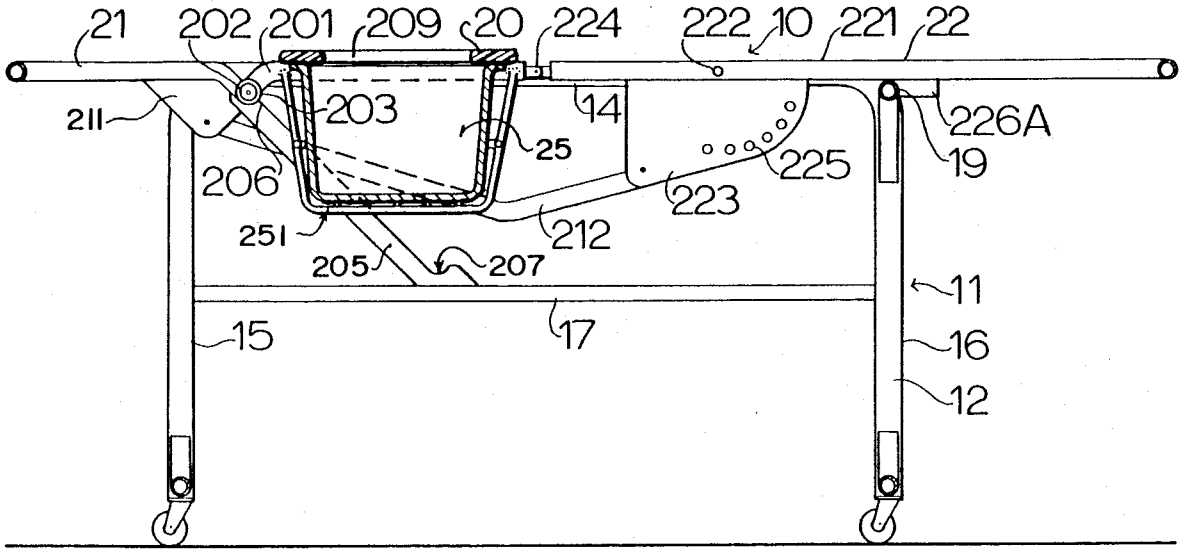
FIG. 1 is a transverse cross-sectional view of a toilet apparatus in a first position thereof.

The toilet apparatus comprises a patient support section 10 mounted on a frame arrangement generally indicated at 11. The frame comprises a pair of inverted U-shape frame members forming respective sides of the apparatus and indicated at 12 and 13 respectively. Each of the frame sides includes a transverse member 14 and a pair of legs 15, 16. The legs are interconnected in the plane of the respective side by a support strut 17 and a transverse support strut interconnects adjacent pairs of legs across from one side to another as indicated at 18. In addition, a handle member 19 connects across from one side to the other at one end of the upper transverse members 14 to retain the frame rigid and to provide a bar which can be grasped by a user when required.

On the frame is mounted the patient support 10. This comprises a seat portion 20, a leg rest portion 21 and a back rest portion 22. Each of these is formed of a tubular frame to which is attached a suitable material covered by a smooth imperforate sheet layer for example vinyl or other suitable plastics which can be easily wiped and sterilized.

The back rest portion 22 comprises the generally planar tubular frame and cushion support portion 221, a pair of pivot pins 222 and an arcate adjustment plate 223. The back rest portion can therefore pivot about the pins 222 relative to the transverse members 14 of the frame sides. It will be noted that the pins 222 are spaced from the lowermost end of the back rest portion which is coupled to the seat portion 20 by a hinge or pivot coupling 224. The arcate adjustment plate 223 includes a number of latch pin holes 225 which cooperate with a plate 226 (FIG. 3) which is apertured so that a pin passing through the plate and through the latch plate 223 can lock the back rest into a required angular position. In addition, the back rest includes a further latch plate 226A which can cooperate with a suitable latch on the handle 19 to retain the back rest portion in the horizontal planar position illustrated in FIG. 1.

The front edge of the seat portion 20 curves downwardly as indicated at 201 and carries at its lower-most end a shaft 202 which in turn supports a pair of nylon spools or runners 203 each of which cooperates with a respective cam track 204, 205 on respective sides of the frame. The cam track extends from an upper corner of the frame side down to the transverse support strut 17 and lies in the plane of the respective frame side as indicated best in FIG. 2.

The cam track 205 is inclined rearwardly and downwardly and also includes a notch at the upper end as indicated at 206 and a second notch 207 at the lower end so as to properly located the spool 203 at either end of its normal travel.

The leg rest portion 21 is of a similar construction to the back rest portion 22 and is pivotally mounted on the shaft 202. A coupling plate 211 is attached to a rear side of the leg rest portion 21 for pivotally receiving a movement transmission strut 212 which connects to the latch plate 223. The strut 212 is suitably cranked to communicate pivotal movement of the back rest portion 22 into similar pivotal movement of the leg rest portion 21.

Figure 3:
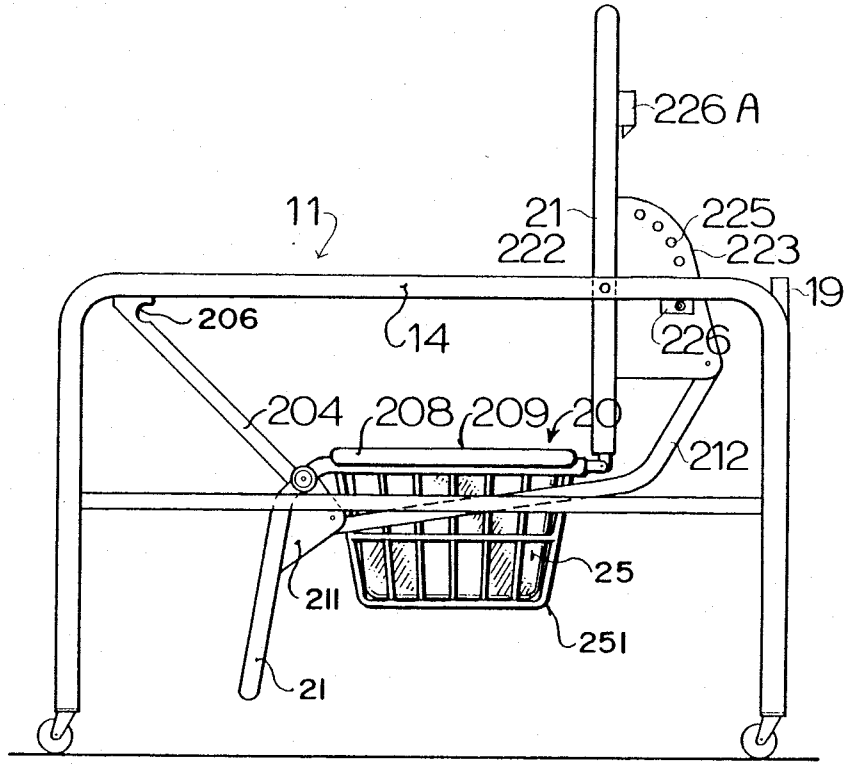
FIG. 3 is a side elevational view of the apparatus of FIG. 1 moved into a second position.

Close inspection of the positions illustrated in FIGS. 1 and 3 will show the movement of the patient support 10 from a horizontal planar position as an upper surface of the frame 11 into a second position illustrated in FIG. 3 which provides a seating position for the patient. The movement which achieves the seated position is a simple movement requiring relative slow controlled movement of the spools 203 along the cam tracks 204, 205 from the upper notch 206 downwardly toward the lower notch 207. As this movement occurs, pivoting takes place at the pivot pins 222 of the back rest portion and at the hinge 224 between the back rest and the seat. The strut 212 similtaneously acts to crank the leg rest portion 21 downwardly into the seated condition illustrated in FIG. 3.

As explained previously the seated condition can be adjusted simply by latching the back rest portion at a required angle at which point the spools 203 will halt on the relevant position of the cam track retaining the seat portion horizontal.

It will be noted that the position of the pivot pins 222 along the back rest portion 222 is chosen to approximate the height of the waist of the occupant so that when pivotal movement occurs about the pins 222, the center of gravity of the patient remains substantially at the height of the transverse frame sides 14. Thus movement between the first and second positions can be achieved without a great deal of effort or leverage since effectively the only force required is that to overcome friction in the parts.

The seat portion 20 basically comprises a toilet seat 208 with a central opening 209 of conventional size and shape. The seat portion 20 includes side edges which releasably engage over the seat frame for locating the portion in place on the frame with the opening centrally positioned. The portion can this be removed upwardly from the frame. Beneath the seat portion 20 is attached a support 251 which can support a toilet bucket 25 which can be moved into position through the frame onto the support with the seat portion removed to take up a position beneath the opening 209. After use the seat portion can be lifted from the frame to expose the bucket which can then be removed for cleansing. The positioning of the pan directly underneath the seat portion ensures that the pan is properly positioned beneath the opening 209 regardless of the position of the seat portion along the cam track 204, 205 and thus the pan can be properly used regardless of the angle of the seated position of the occupant which of course depends upon the degree of infirmity of the occupant. The mounting of the bucket on the support and its vertical removal enable the depth of the bucket to be sufficient to receive a layer of water in the bottom and to prevent any body parts from coming into contact with the bucket or with water.

The support 251 can be manufactured as a complete wire frame to allow removal of the bucket only at the top, or alternatively it may have a side or rear opening to allow sliding of the bucket outwardly through that opening.

Figure 2:
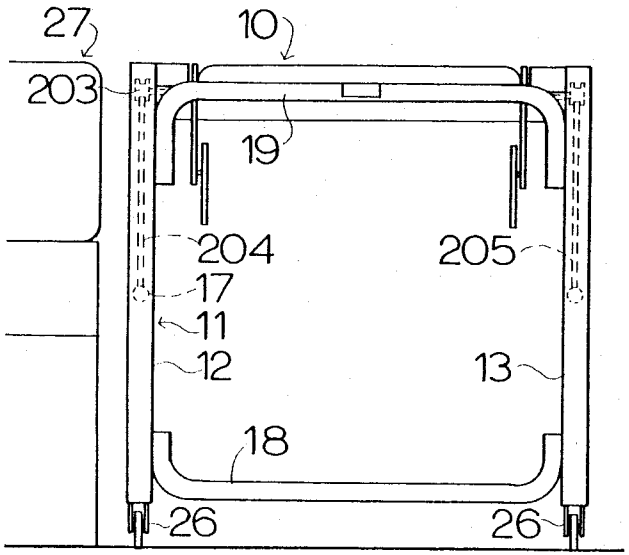
FIG. 2 is an end elevational view of the apparatus of FIG. 1.

Suitable locking castors 26 are provided on the lower ends of the legs so that the frame can be moved into suitable position alongside a bed indicated at 27 in FIG. 2.

In operation, therefore, the frame is positioned as shown in FIG. 2 with the patient support substantially horizontal and at the same level as the mattress of the bed. The patient is then moved across onto the apparatus in the lying position and taken wholly from the bed. When lying properly on the patient support, the back rest portion 22 is lifted slowly and carefully to move the patient into the seated condition shown in FIG. 3. In this position the patient can make use of the toilet facilities in a dignified comfortable condition properly supported in a seated position and securely located within the frame with the possibility of using the frame sides 14 as arm rests.

When complete the patient can simply be returned to the lying condition by lowering movement of the back rest portion 22 and then can be returned to the bed in conventional manner.

Patient restraints can be added to the frame to ensure that particularly infirm patients are properly held in position during the operation.

Figure 4:
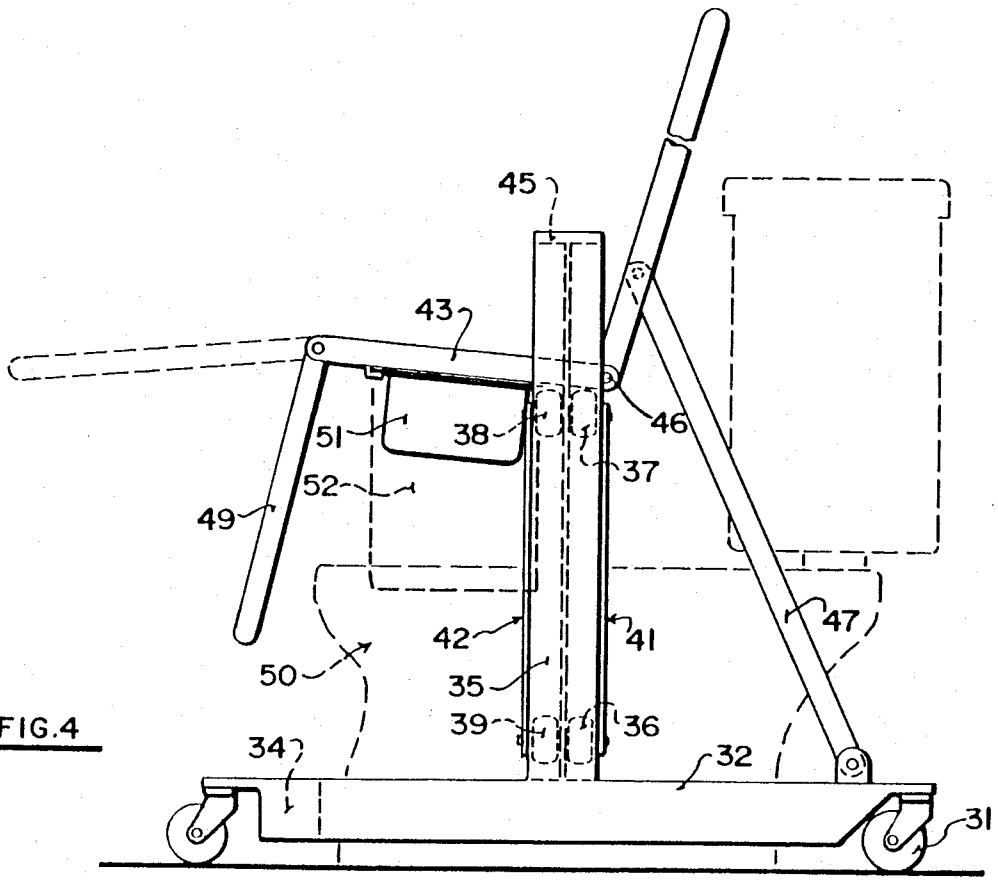
FIG. 4 is a side elevational view of an alternative device.
Figure 5:
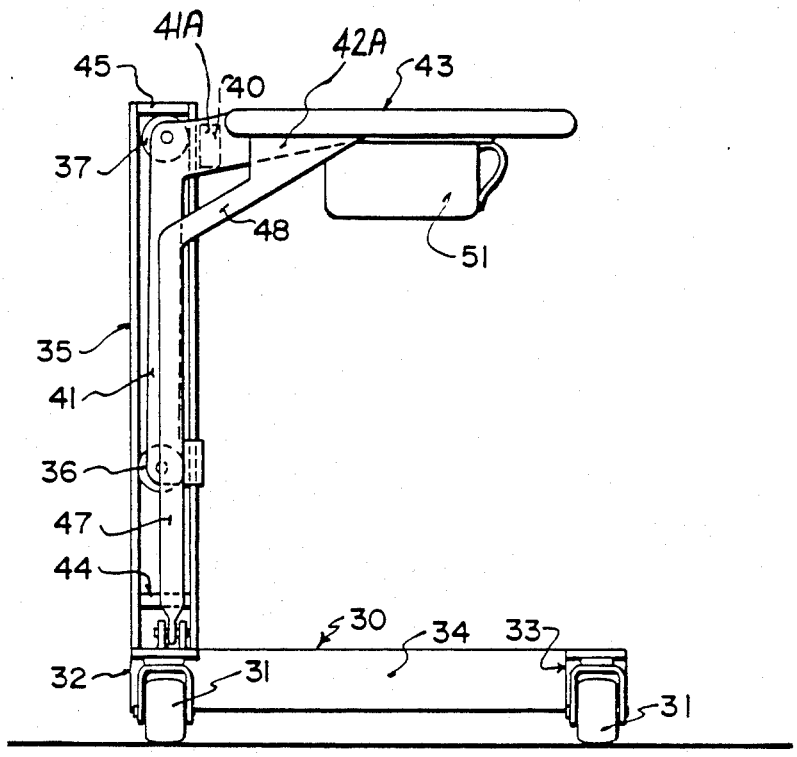
FIG. 5 is an end elevational view of the device of FIG. 4 showing the patient's support in the horizontal position.

FIGS. 4 and 5 show an alternative arrangement which operates and is arranged substantially in the manner as described herein in relation to FIGS. 1, 2 and 3.

In this case, however, the frame is formed by a lower base frame 30 which lies in a horizontal plane and carries four castor wheels 31 at respective corners of the rectangular frame. The frame is formed by two side members 32 and 33 and a transverse coupling member 34 arranged only at the foot end of the device leaving the side members 32 and 33 unconnected at the forward or head end of the device. From the base frame is provided an upstanding post 35 which forms substantially the whole cantilever support for the patient support mounted thereon. The post 35 is of I-beam cross-section defining two channels each on respective sides of the post and each channel receiving a pair of guide wheels 36, 37 and 38, 39. The guide wheels are carried on a bifurcated structure 40 which includes a first strap 41 coupling the wheels 36 and 37 and a second strap 42 coupling the wheels 38 and 39 for conjoint movement along the length of the post 35. The upper end of the bifurcated structure 40 includes a cross piece 41*a* which holds the structure together together with an outwardly extending lever 42*a* which carries the seat portion of the patient support indicated at 43. Thus the seat portion 43 can move directly upwardly and downwardly on the post 35 with the lower extent of the movement controlled by a bottom stop 44 and the upper extent of the movement controlled by a top stop 45 positioned to control the movement of the seat portion between the horizontal position of the patient support and the seated position of the patient support shown in FIGS. 5 and 4 respectively.

The back frame of the patient support is pivotally coupled to the seat portion at an axis 46 and extends outwardly therefrom. The back portion defined by the back frame is therefore pivotally coupled to the seat portion and is held in its required position by a rigid link 47 which extends from the base frame side member 32 up to the back frame to which it is coupled in a cantilever manner by a lever portion 48. The operation of the device is therefore very similar to that previously described in that the seat portion can be raised and lowered automatically moving the back portion from its horizontal position to its raised position. The positioning of the pivot axis 46 and the pivot connection between the lever 48 and the back frame ensures that the patient's center of gravity remains substantially constant.

The leg support indicated at 49 is also pivotally coupled to a front edge of the seat portion and is movable between adjustable positions by any suitable manually actuable setting means which allows it to be retained in the horizontal location or to any position between the horizontal location and a substantially vertical location as required for the comfort of the patient.

As the device in this embodiment is supported in cantilever manner from the post 35, the patient support can be drawn to a position adjacent the side of the bed and can be pushed so that the patient support moves across the upper surface of the bed toward the patient so that patient can be drawn or rolled on to the support by a single attendant working from a position on the outside of the device with the device between the attendant and the bed. In this way the patient can be rolled away from the device, the device pushed so that the patient support passes under the patient and then the patient rolled back onto the patient support without the danger of the device slipping away since it is held by the body of the attendant into its required position.

With the patient moved on to the support, movement into the seated position can be obtained as previously described.

The construction of the base frame as a U-shape allows the device to be moved over a conventional toilet bowl indicated in dotted line 50. In this case the toilet bucket 51 can be removed from its mounting between the seal portion and a rubber sleeve inserted in its place as indicated at 52 to direct any materials from the patient into the toilet bowl. Thus the device as shown in FIGS. 4 and 5 can be used either with a conventional toilet if there is room for the device to be moved through the doorway and onto the toilet bowl or in other cases where this is not possible the toilet bucket 51 can be used as previously described.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A toileting apparatus for use by bed ridden patients comprising a patient support including a seat portion, and a back rest portion, one edge of the back rest portion being pivotally connected to the seat portion at an adjacent edge thereof, frame means mounting said portions such that they can be moved from a first position in which they lie in a substantially flat co-planar relationship for supporting the patient in a lying condition to a second position in which the back rest portion inclined upwardly from the seat portion for supporting the patient in an at least the seat portion for supporting the patient in an at least partially seated condition, said frame means comprising a substantially rectangular base frame having ground wheels thereon for movement across the ground, upstanding support means arranged solely on one side portion of said base frame and means for supporting said patient support in canti-lever manner outwardly from said upstanding support means over said base frame so that the patient support can be pushed underneath the patient on top of a bed surface by an operative standing on the side of the base frame remote from the bed, the base frame being of U-shape in plan defining a front portion, two side portions and an open rear face underlying the back rest portion so that the base frame can be moved to a position surrounding a conventional toilet bowl with the seat portion directly overlying the conventional toilet bowl, rolling bearing means mounting said patient support on said upstanding support means for free sliding movement thereon in a vertical direction, a rigid link pivotally connected at one end to a point on the back rest portion spaced outwardly from the seat portion and pivotally connected at the other end to the base frame such that movement of the back portion from said second position to said first position will cause movement of said seat portion upwardly along said upstanding support which causes movement of the patient to occur substantially about the center of gravity of the patient whereby the center of gravity of the patient remains at a substantially constant height as said patient support moves from said first position to said second position and vice versa, means for causing said movement from said first position to said second position consisting solely of manually graspable portions of said seat portion and said back rest portion whereby the patient is raised and lowered by manual lifting force, the seat portion being apertured for use as a toilet seat, and means for supporting a toilet bucket positioned beneath the seat portion for use in the second position of the patient support.

2. The invention according to claim 1 wherein the patient support includes a leg rest portion movable from the first position in which it is coplanar with said seat portion to the second position in which it is inclined downwardly from said seat portion.

3. The invention according to claim 1 wherein said means for supporting the toilet bucket is attached to an underside of said seat portion for supporting said bucket in direct attachment to the underside of the seat portion for movement therewith from said first position to said second position.

* * * * *